US009161871B2

(12) United States Patent
Clement et al.

(10) Patent No.: US 9,161,871 B2
(45) Date of Patent: Oct. 20, 2015

(54) MULTIPLE FUNCTION PATIENT HANDLING DEVICES AND METHODS

(75) Inventors: Gideon M. Clement, Rifton, NY (US); Seth C. Swinger, Rifton, NY (US); Paul D. Wipf, Rifton, NY (US)

(73) Assignee: COMMUNITY PRODUCTS, LLC, Rifton, NY (US)

( * ) Notice: Subject to any disclaimer, the term of this patent is extended or adjusted under 35 U.S.C. 154(b) by 953 days.

(21) Appl. No.: 13/342,832

(22) Filed: Jan. 3, 2012

(65) Prior Publication Data

US 2012/0174314 A1 Jul. 12, 2012

Related U.S. Application Data

(60) Provisional application No. 61/430,243, filed on Jan. 6, 2011.

(51) Int. Cl.

| | |
|---|---|
| ***A61G 7/10*** | (2006.01) |
| ***A61G 7/12*** | (2006.01) |
| ***A61G 7/14*** | (2006.01) |

(52) U.S. Cl.

CPC ..... *A61G 7/10* (2013.01); *A61G 7/1019* (2013.01); *A61G 7/1046* (2013.01); *A61G 7/1051* (2013.01); *A61G 7/109* (2013.01); *A61G 7/1086* (2013.01); *A61G 7/1092* (2013.01); *A61G 7/1094* (2013.01); *A61G 7/1096* (2013.01); *A61G 2200/34* (2013.01); *A61G 2200/36* (2013.01); *A61G 2200/52* (2013.01); *A61G 2200/58* (2013.01); *A61G 2200/60* (2013.01)

(58) Field of Classification Search

CPC ..... A61G 7/1017; A61G 7/1019; A61G 7/10; A61G 7/1046; A61G 7/1051; A61G 7/1086; A61G 7/109; A61G 7/1092; A61G 7/1094; A61G 7/1096

USPC ..... 5/81.1 R, 83.1, 86.1, 87.1

See application file for complete search history.

(56) References Cited

U.S. PATENT DOCUMENTS

| | | | | | |
|---|---|---|---|---|---|
| 4,065,179 | A * | 12/1977 | Takasaki | 297/464 |
| 4,117,561 | A | 10/1978 | Zamotin | |
| 4,704,749 | A | 11/1987 | Aubert | |
| 5,117,516 | A | 6/1992 | Penner | |
| 5,185,895 | A * | 2/1993 | Gagne et al. | 5/86.1 |
| 5,309,584 | A | 5/1994 | Parker | |
| 5,379,468 | A | 1/1995 | Cassidy et al. | |
| 5,459,891 | A * | 10/1995 | Reeve et al. | 5/87.1 |
| 5,758,371 | A | 6/1998 | Van Dyke et al. | |
| 6,092,247 | A | 7/2000 | Wilson | |
| 6,389,619 | B1 | 5/2002 | Dunn | |
| 7,392,554 | B1 | 7/2008 | Su et al. | |
| 7,434,278 | B2 | 10/2008 | White et al. | |
| 7,437,782 | B1 * | 10/2008 | Burns | 5/87.1 |
| 7,657,951 | B2 * | 2/2010 | Tally | 5/86.1 |
| 2007/0000049 | A1 * | 1/2007 | White et al. | 5/84.1 |
| 2007/0094791 | A1 * | 5/2007 | Walker | 5/81.1 R |
| 2011/0056019 | A1 * | 3/2011 | Altena et al. | 5/87.1 |
| 2012/0023661 | A1 * | 2/2012 | Ota et al. | 5/86.1 |

* cited by examiner

*Primary Examiner* — Michael Trettel
(74) *Attorney, Agent, or Firm* — Baker Botts L.L.P.

(57) ABSTRACT

Devices and methods for moving a person having a support base, a linear vertical movement assembly, a linear horizontal movement assembly, and a body support for the person, such that the linear movement assemblies operate independently and can be separately commanded by a user.

20 Claims, 12 Drawing Sheets

MULTIPLE FUNCTION PATIENT HANDLING DEVICES AND METHODS

CROSS-REFERENCES TO RELATED APPLICATIONS

This application claims the benefit of U.S. Provisional Application No. 61/430,243 filed Jan. 6, 2011.

FIELD OF THE INVENTION

This invention relates to a multiple function patient handling device and methods of use. More specifically the invention relates to: the assisting of physically disabled persons to stand up or sit down; the support of such persons as they walk; rehabilitative gait training; and the bodily lifting and transfer of invalids.

BACKGROUND OF THE INVENTION

A diversity of patient handling and assisting problems may be found in any healthcare environment that deals with physically disabled persons. For this reason, single devices capable of performing a variety of assistive functions are of obvious value both to care facilities and to mobility impaired individuals in private care situations.

Several devices already exist that attempt to provide such multiple functionality. Examples include the devices disclosed by Wilson in U.S. Pat. No. 6,092,247, Su et al. in U.S. Pat. No. 7,392,554, Aubert in U.S. Pat. No. 4,704,749, and Dunn in U.S. Pat. No. 6,389,619. These devices aim to raise a disabled person in the seated, standing, or semi-standing postures for transfer between various objects, such as between a wheelchair and bed or commode, as well as to assist the person in standing and walking.

Most of these devices, including those mentioned above, lift the person along a line or arc to which little or no modification can be made, resulting in undesirable characteristics or limitations in the way the device performs one or the other of the intended functions.

For example, the device discussed in the Aubert patent lifts along a vertical path and thus should function well as a means to raise and reposition a person while that person is held in a seated posture. However, a standing motion requires that the person's torso be moved forward as well as upward to place the body in a balanced upright position where the center of gravity is above the feet. While a person's torso could be moved forward with such a device by having the caregiver or a wheel drive system roll the device forward while the device lifts the person vertically, such rolling requires extra effort on the part of the caregiver. In addition, knee and shin abutments are typically incorporated in standing motion devices to stabilize the legs and prevent the lower body from swinging forward disadvantageously during the standing motion. However, even if the Aubert patent were to include such abutments, the rolling of the device to move the torso forward would move the abutments away from the person, negatively affecting the lifting-to-standing action.

Other devices, such as those discussed by Wilson in U.S. Pat. No. 6,092,247, Su et al. in U.S. Pat. No. 7,392,554, and Dunn in U.S. Pat. No. 6,389,619, lift along a fixed arc or line that moves forward as well as up and likely serve well as standing aids. However, such devices have limitations as transfer devices because any vertical movement of the person is accompanied by substantial horizontal movement, especially along the upper region of the fixed arc. This horizontal movement forces the caregiver to constantly monitor and adjust the position of the device as the person is lowered, to prevent the person from being placed too far forward or rearward on the object onto which he or she is being seated. Similarly, the added horizontal movement also makes transfers between objects of significantly different heights awkward or difficult as should be appreciated by persons with knowledge of invalid care environments who must navigate persons between objects such as commodes and therapy tables, which are generally lower in height and changing tables, hospital beds and powered wheelchairs which are usually considerably higher.

BRIEF SUMMARY OF THE INVENTION

An innovative aspect of this invention, and a means by which the aforementioned limitations are overcome, is to provide an improved multiple function device having two linear motion mechanisms that can act independently and perpendicularly to each other, but which also can act together to move a body support assembly along a variable path that can be selected and modified by the caregiver as needed to perform a desired function.

Another innovative aspect of this invention is to provide a multiple function device which enables a caregiver to easily and comfortably perform the bodily transfer of a person in the seated posture between objects of significantly different heights, and also to raise such a person in a natural way to a balanced standing position from which the person can begin walking or gait training, without having to mechanically reconfigure the device. According to this aspect, the caregiver uses a hand control to move and adjust the body support as needed for the desired function.

Another aspect of this invention is to provide a person handling device having: (a) a base having a front end and rear end; (b) a first linear movement assembly having an adjustable length extending upwardly from a first end, which is connected to the front end of the base, to a second end; (c) a second linear movement assembly having an adjustable length extending away from a first end, which is connected proximate to the second end of the first linear movement assembly, to a second end; and/or (d) a body support attached to the second end of the second linear movement assembly, such that each of the first linear movement assembly and the second linear movement assembly have at least one respective activator that permits each movement assembly to adjust the respective length independently of the other movement assembly. This device can also have one or more activators that permit the first and second movement assemblies to adjust the respective adjustable lengths simultaneously.

A further aspect of this invention is to provide a person handling device having a control unit, which can be a manual control unit, with one or more of the following activators: an upward vertical activator for extending the first linear movement assembly, a downward vertical activator for retracting the first linear movement assembly, a forward horizontal activator for retracting the second linear movement assembly, a rearward horizontal activator for extending the second linear movement assembly, an upward vertical and forward horizontal activator for extending the first linear movement assembly and retracting the second linear movement assembly, and/or a downward vertical and rearward horizontal activator for retracting the first linear movement assembly and extending the second linear movement assembly.

A further aspect of this invention is to provide a person handling device having a body support which has: (a) a first pad assembly; (b) a second pad assembly; and (c) a centering mechanism connecting the first pad assembly to the second pad assembly, such that the movement of one pad assembly moves the other pad assembly: (1) to maintain the body support along the center line of the device; and/or (2) to support the person in the body support along the center line of the device. In addition, the centering mechanism can be a cross link.

Another aspect of this invention is to provide a person handling device having an excessive force detection circuit which has a current monitoring circuit which detects current above a predetermined threshold driving at least one of the movement assemblies and a shut-off circuit which stops movement of the movement assemblies by shutting off the motors of the movement assemblies when the detected current exceeds the predetermined threshold. At least part of the current monitoring circuit and/or at least part of the shut-off circuit can be provided by program instructions in a controller attached to the device.

Yet another aspect of this invention is to provide a person handling device having: (a) at least one abutment attached to the base for contacting a person's shin or knee, the abutment having an articulation joint allowing the abutment to be moved relative to the base; (b) at least one thigh support attached to the base, the thigh support having an articulation joint allowing the thigh support to be moved relative to the base; (c) at least one abutment removeably attached to the base for contacting a person's shin or knee; and/or (d) at least one thigh support removeably attached to the base.

A further aspect of this invention is to provide a person handling device having a base further which has two side rails; and a cross beam, the cross beam having a first portion and a second portion, each portion connected at one end to a respective side rail and connected at the other end to a respective articulation joint, the articulation joints being connected to the first linear movement assembly.

An additional aspect of this invention is to provide a method of moving a person with a person handling device having the steps of: (a) causing a command signal to drive a first linear movement assembly to move the traveling end of the movement assembly independently of a second linear movement assembly; and (b) causing a command signal to drive the second linear movement assembly to move the traveling end of the second linear movement assembly independently of the first linear movement assembly, the traveling end of the second linear movement assembly being attached to a body support assembly which is attached to the person.

This method can also include the steps of: (1) causing command signals to simultaneously drive both the first and second linear movement assemblies; (2) activating at least one activator on a control unit to cause at least one command signal; (3) placing the person in the body support such that the person will be held along the centerline of the device by moving one of two pad assemblies to contact the person's torso beneath the person's arms; and/or (4) detecting current above a threshold being output to at least one of the linear movement assemblies and stopping the motion of the linear movement assemblies when such current is detected. The activating step can be pressing a button on the control unit.

The construction of the invention, and the methods by which the devices of the invention are used, are further elaborated upon in the following sections with reference to the drawings.

DETAILED DESCRIPTION OF INVENTION

Figure 1:
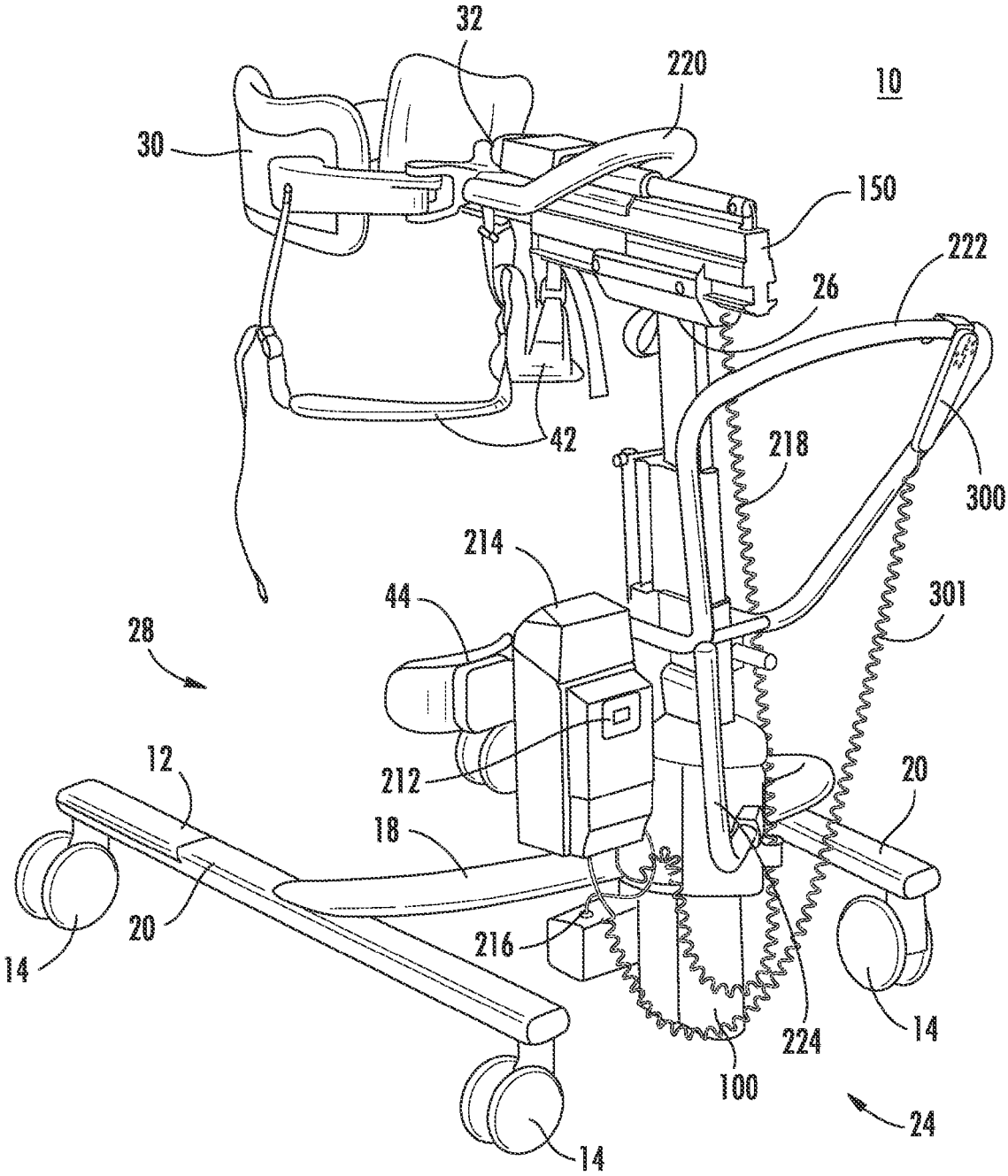
FIG. 1 is a perspective view of a device according to an embodiment of the invention.
Figure 2:
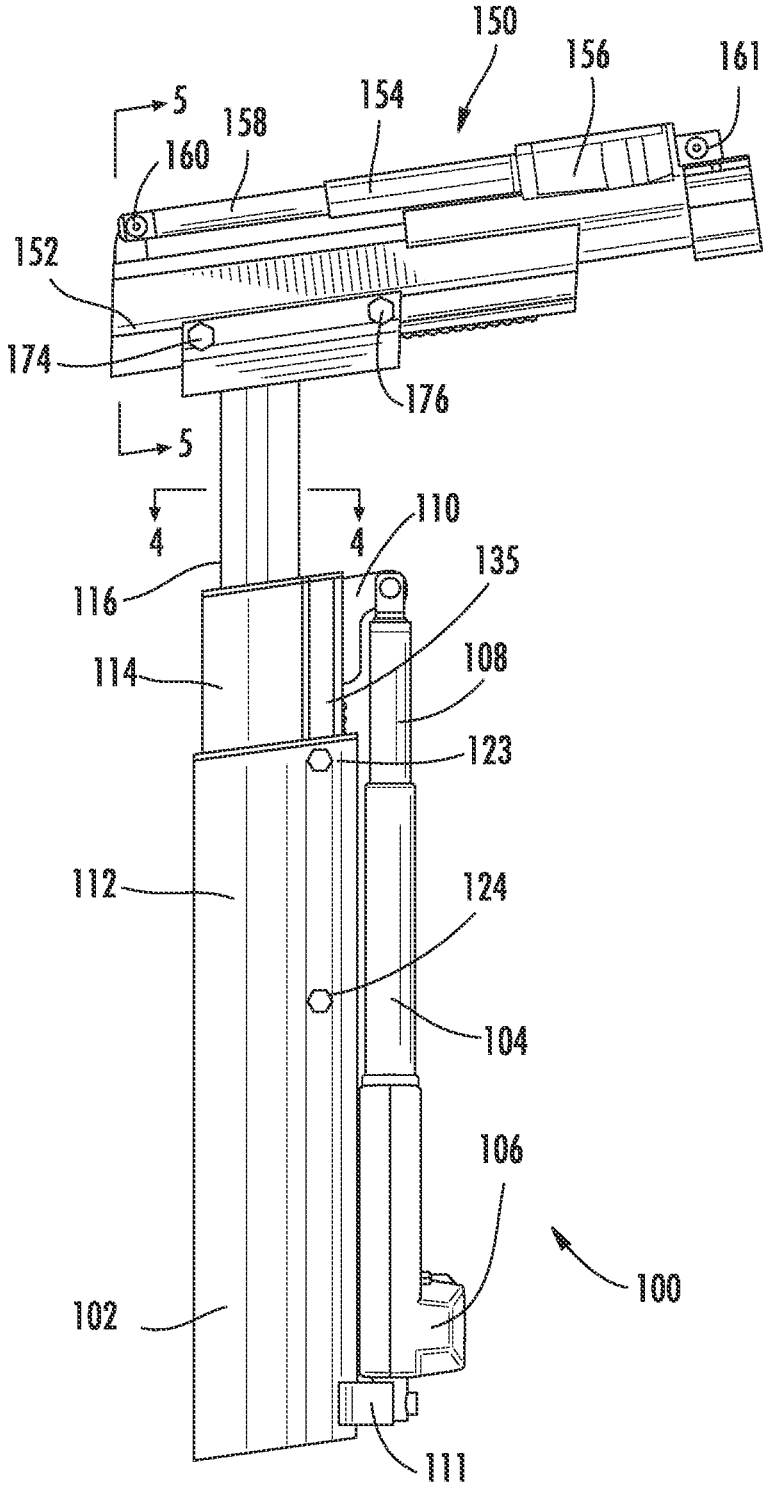
FIG. 2 is a side view of the vertical and horizontal movement assemblies according to an embodiment of the invention.
Figure 12:
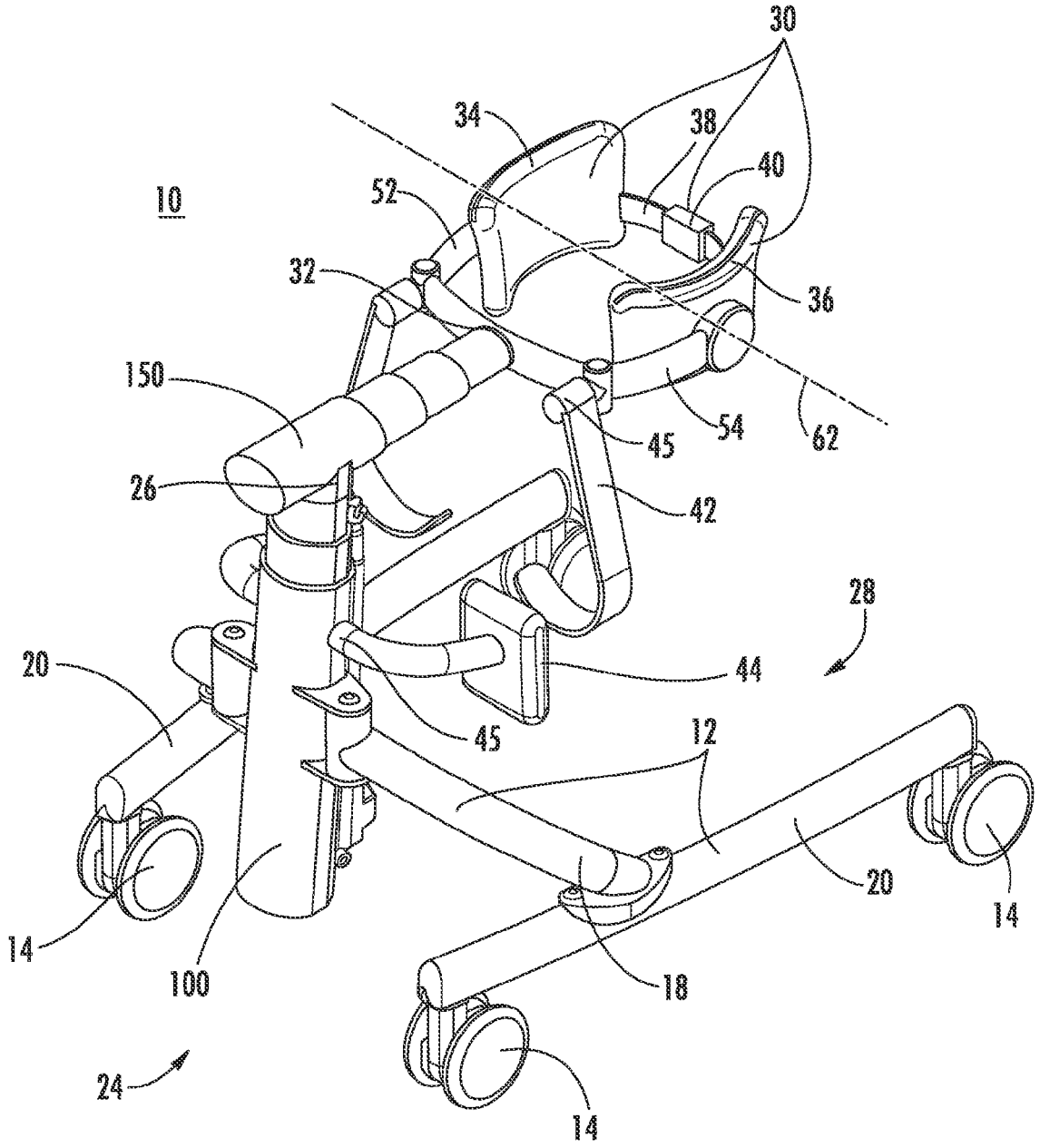
FIG. 12 is a perspective view of a device according to another embodiment of the invention.

FIGS. 1 and 12 illustrate multiple function patient handling devices 10 according to at least two embodiments of this invention which operate on a floor. The multiple functions of each of these devices include: (1) transferring a person from one object to another; (2) aiding a person to stand; (3) aiding a person to remain standing; and (4) aiding a person in walking.

The device 10 of FIG. 1 has a wheeled generally H-shaped base frame 12 with each of four wheels 14 located proximate respective ends of the "H". A linear vertical movement assembly 100 connects to a cross beam 18 which joins the rails 20 of the base frame 12. The cross beam 18 is U-shaped and extends upward toward the front 24 of the device 10 at an approximately 25 degree angle. A linear horizontal movement assembly 150 is attached proximate the front 24 of the device 10 to the upper end 26 of the vertical movement assembly 100, is cantilevered above the base frame 12, and extends towards the rear 28 of the device 10. In this embodiment, the vertical movement assembly 100 is oriented at about 5 degrees toward the rear 28 of the device 10 from a right angle with respect to the floor, and the horizontal movement assembly 150 is approximately parallel to the floor. A body support assembly 30 is attached to the traveling end 32 of the horizontal movement assembly 150 and includes leg support straps 42.

The device 10 of FIG. 1 is controlled by a user from a manual control unit 300 which is connected by a wire 301 to a controller unit 212. The manual control unit 300 and the controller unit 212 are powered by a rechargeable battery power supply 214 attached to the cross beam 18 of the base frame 12. The power supply 214 also provides power to the movement assemblies 100, 150 via wires 216, 218.

The device 10 of FIG. 1 also includes a grab handle 220 attached to the horizontal movement assembly 150 for use by the person in the device and a larger roll movement handle 222 is attached to the vertical movement assembly 100 for use by the caregiver to move the device 10 across the floor. As discussed more fully below, another handle 224 is provided to pivot the rails 20 of the base frame 12 toward or away from each other.

FIGS. 2, 3, 4 and 5 illustrate the vertical and horizontal movement assemblies 100, 150. Each movement assembly 100, 150 includes a three-stage telescoping column 102, 152, a linear actuator 104, 154, and connectors 110, 111, 160, 161 to attach the respective actuator to the respective column.

The vertical movement assembly 100 should have a stroke length of not less than approximately 508 millimeters (20 inches), and in one embodiment is approximately 650 millimeters (25.6 inches). The vertical movement assembly 100 should be constructed to be compact and collapse to a low height, which in one embodiment is approximately 565 millimeters (22.25 inches). In one embodiment, the vertical actuator 104 is a conventional electromechanical linear actuator, such as the LA31 linear actuator supplied by Linak Inc. of Denmark, which includes a motor 106, a gear-nut-spindle mechanical assembly (not shown) and a piston rod 108.

The horizontal movement assembly 150 should have a stroke length of not less than approximately 254 millimeters (10 inches), and in one embodiment is approximately 380 millimeters (14.96 inches). In one embodiment, the horizontal actuator 154 is a conventional electromechanical linear actuator, such as the LA23 linear actuator supplied by Linak Inc. of Denmark, which includes a motor 156, a gear-nut-spindle mechanical assembly (not shown), and a piston rod 158.

For vertical movement, a command signal is sent to the vertical linear actuator 104 which causes the distal end of the rod 108 of the actuator to extend or retract. Because the distal end of the rod 108 of the actuator 104 is attached to the second stage 114 of the column 102 by a connector 110 and the proximal end of the actuator is attached to the first stage 112 by a connector 111, as the rod 108 extends or retracts, the connector 110 moves the second stage 114 upward or downward. The second stage 114 of the column 102 is guided by four rollers 132, which are located at positions 123, 124 on both sides of the first stage 112 and ride in tracks 135 located on each side of the second stage 114, and bushings 133 mounted to the first stage 112. Two sprockets 120, 122 are mounted at spaced apart positions on the second stage 114. A chain 126 is anchored at one end 127 to the first stage 112 and at the other end is attached to a connecting pin 128 which is attached to the third stage 116. Accordingly, as the chain 126 rolls around the sprockets 120, 122, the chain pulls or pushes the connecting pin 128 causing the third stage 116 to move upward or downward, guided by rollers 119, 130 in tracks 142, 144, and bushings 146, 148, at a ratio of movement with the second stage 114 of 2 to 1.

For horizontal movement, a command signal is sent to the horizontal linear actuator 154 which causes the distal end of the rod 158 of the actuator to extend or retract. Because the proximal end of the actuator 154 is attached to the third stage 166 of the column 152 by a connector 161 and the distal end of the rod 158 is connected to the second stage 164 by a connector 160 as the rod 158 extends or retracts, the connector 161 moves the third stage 166 rearward or forward relative to the base frame 12. The second stage 164 of the column 152 is guided by four rollers 180, which are located at positions 174, 176 on both sides of the first stage 162 and ride in tracks 183 on each side of the second stage 164, and bushings 182 mounted to the first stage 162. Two sprockets 170, 172 are mounted at spaced apart positions on the second stage 164. A chain 178 is anchored at one end 163 to the first stage 162 and at the other end 165 is anchored to the third stage 166. Accordingly, as the third stage 166 is pulled or pushed, the chain 178 rolls around the sprockets 170, 172 and pulls or pushes the anchor end 163 causing the second stage 164 to move rearward or forward. The third stage 166 is guided by rollers 169, 181 in tracks 187, 191, and bushings (not shown) at a ratio of movement with the second stage 164 of 2 to 1.

Figure 3:
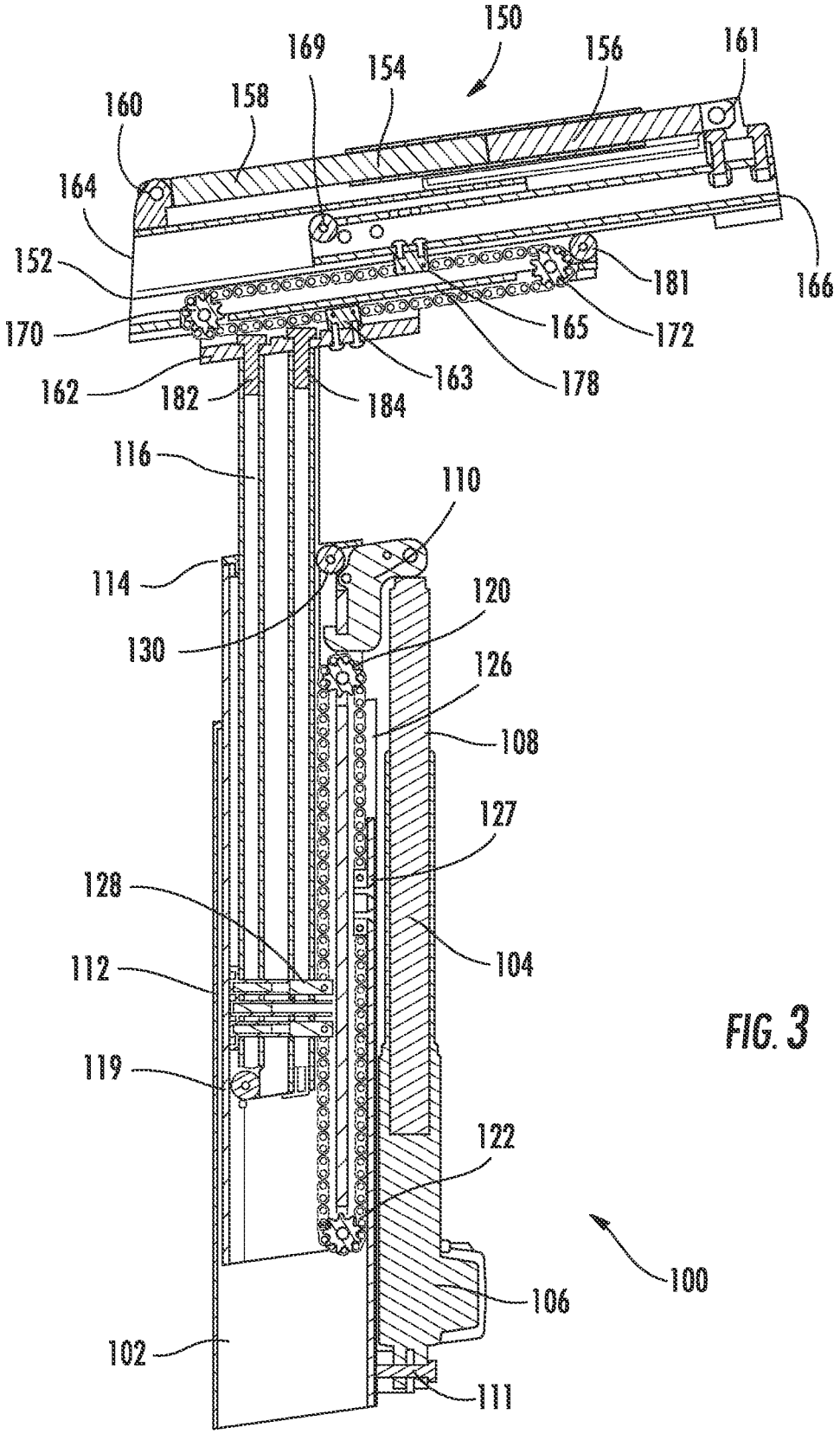
FIG. 3 is a cross-sectional side view of the vertical and horizontal movement assemblies according to an embodiment of the invention.
Figure 4:
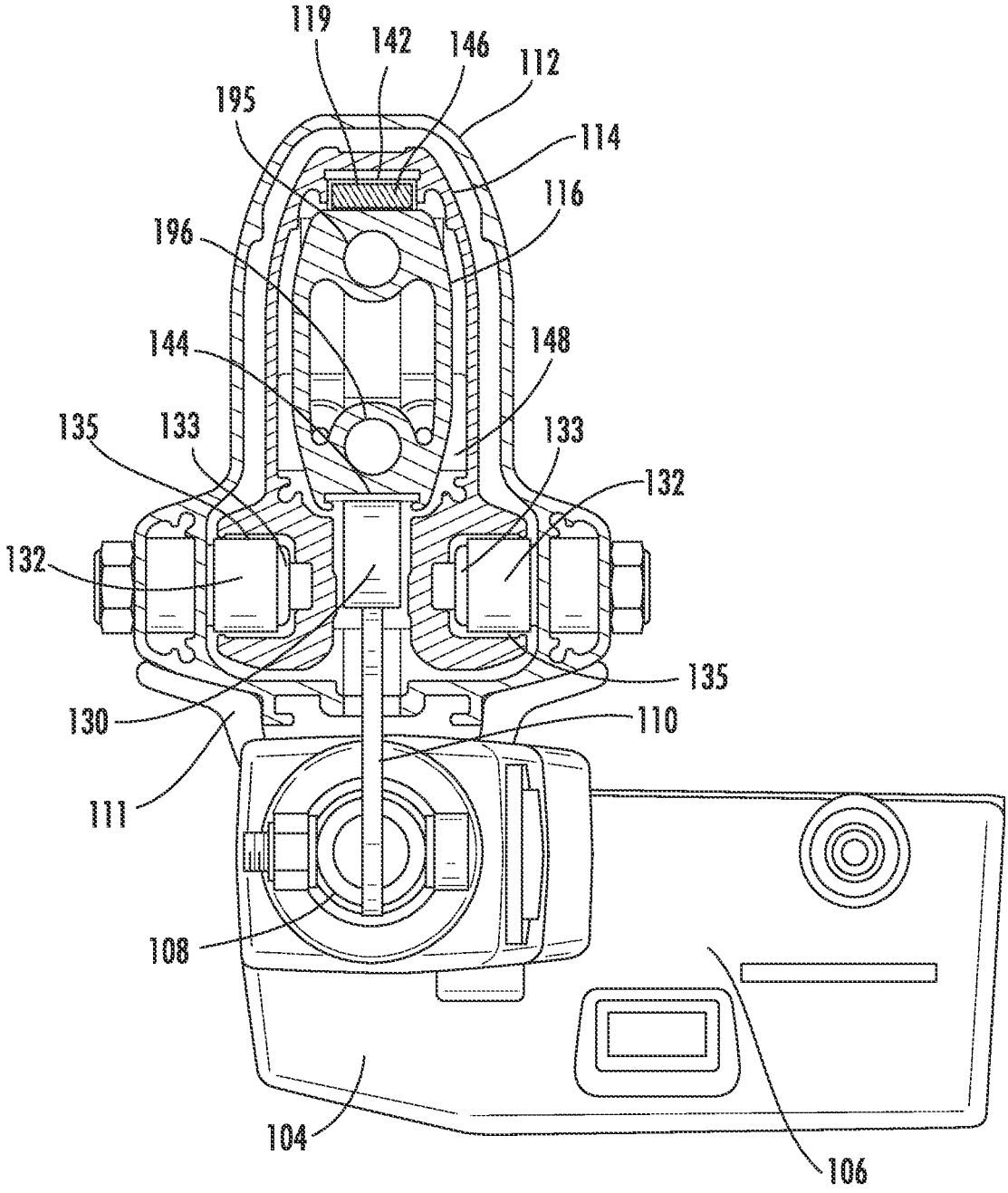
FIG. 4 is a cross-sectional top view of the vertical movement assembly shown in FIGS. 2 and 3.
Figure 5:
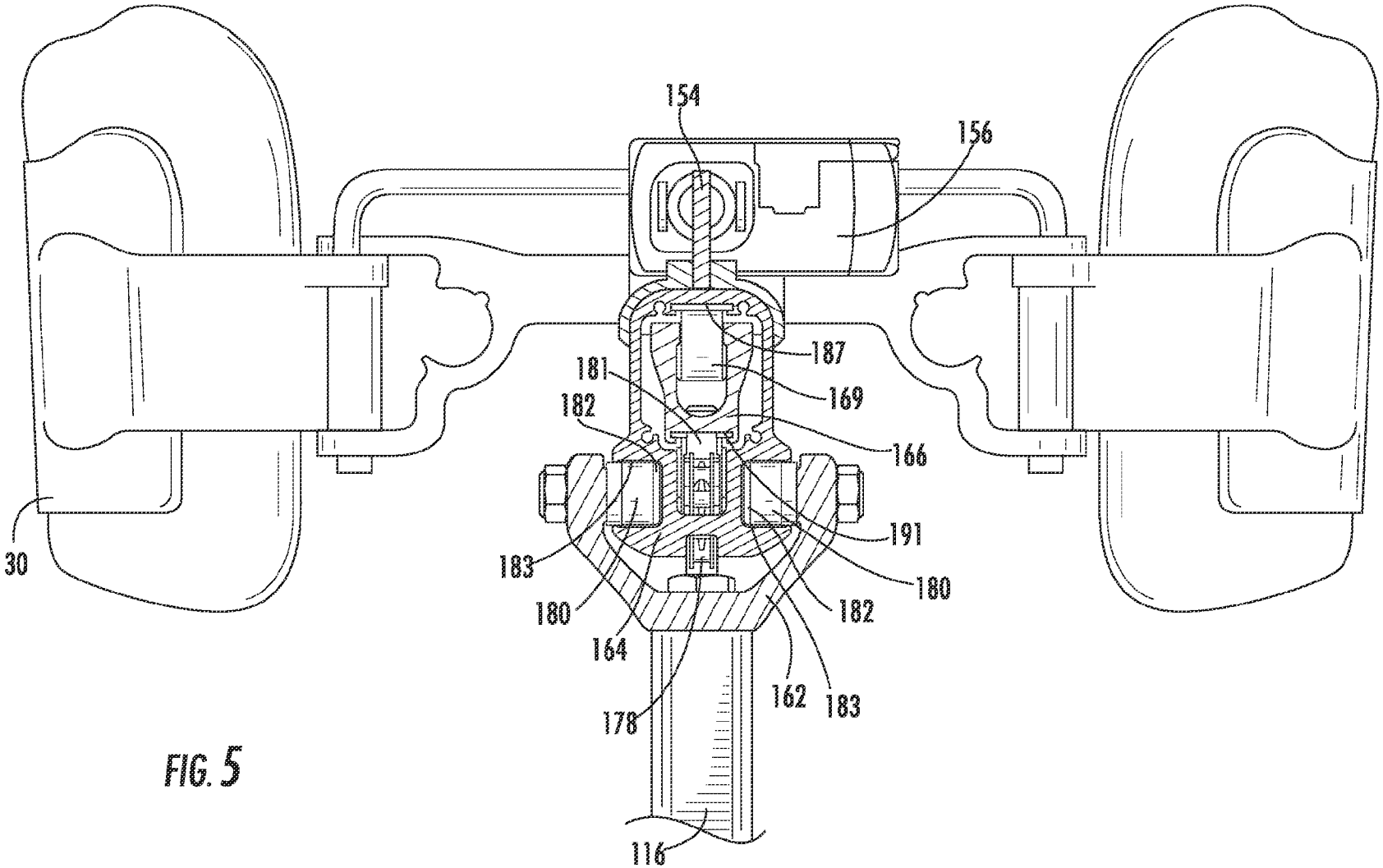
FIG. 5 is a cross-sectional front view primarily of the horizontal movement assembly shown in FIGS. 2 and 3.

As shown in FIGS. 3 and 4, bolts or screws 182, 184 are threaded into tapped holes 195, 196 and attach the proximal end of the horizontal movement assembly 150 to the distal end of the vertical movement assembly 100. However, this invention envisions other types of attachment including, for example, welding, a collar joint, etcetera.

Figure 6:
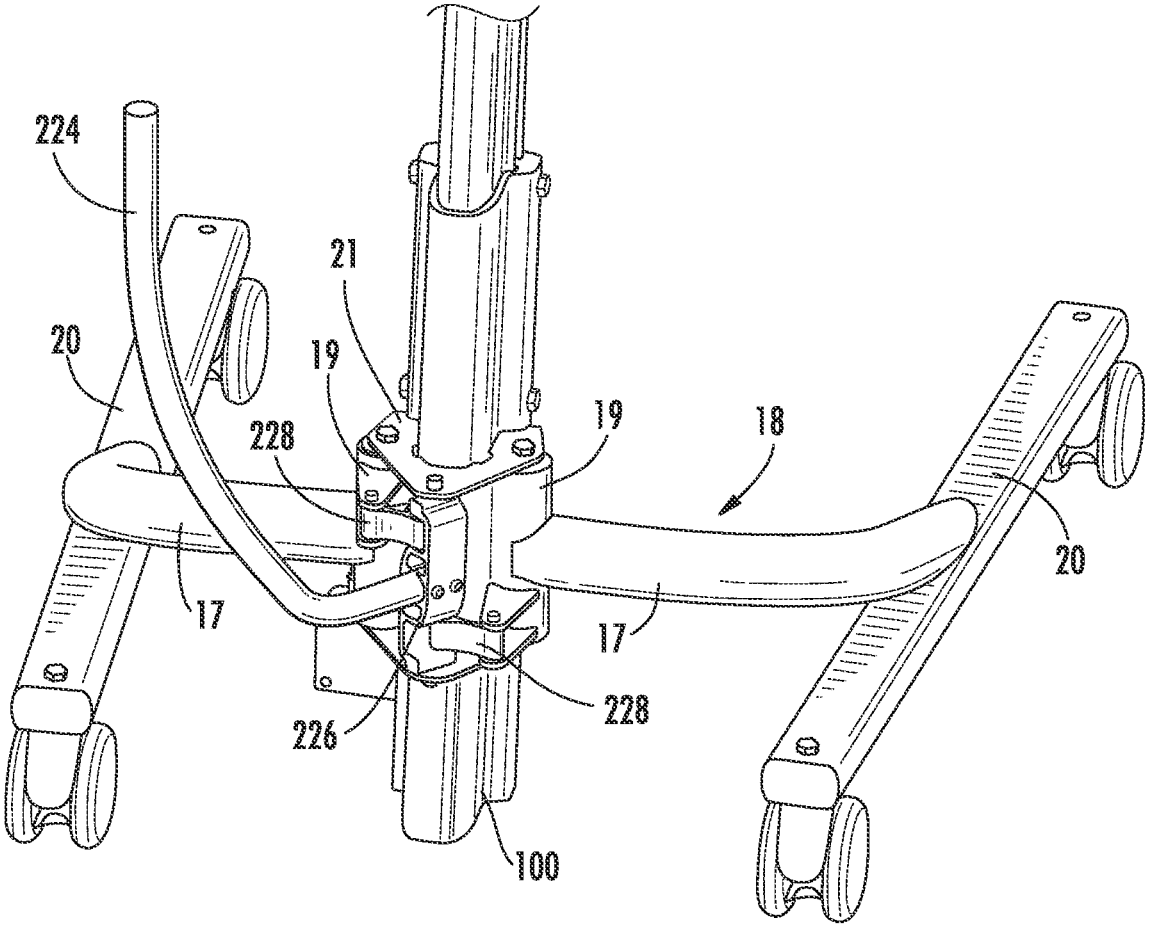
FIG. 6 is a perspective view of the cross beam/rail pivoting assembly of an embodiment of the invention.

As shown in FIG. 6, in one embodiment, the cross beam 18 is formed from two L-shaped tubular portions 17 which are connected with articulation joints 19 to a pivoting mechanism 21 attached to the vertical movement assembly 100. The pivoting mechanism 21 allows the side rails 20 to be spread apart laterally to allow for positioning of the rails on either side of a chair or wheelchair. The handle 224 is connected to an "S"-shaped crankshaft 226 which can rotate about its longitudinal axis. The crankshaft 226 is connected at each end to one end of a respective pivot link 228, the other end of each pivot link is attached to a respective articulation joint 19. Accordingly, when the caregiver rotates the handle 224 in a plane parallel to the floor, the side rails 20 move toward or away from each other. Such positioning allows the device 10 to move the body support assembly 30 directly or almost directly to the person for ease of attachment. Once the person is lifted, the device 10 or the chair or wheelchair can be moved away and the rails 20 retracted so that the device 10 may pass through standard width doorways. Other expandable base frame rail systems are well known in existing patient lifts and hoists and are envisioned as being used with this invention.

In one embodiment, the wheels 14 on the base frame 12 are multi-function casters having functions including anti-backup, variable friction braking and directional locking in forward and trail positions. This type of caster is well known in existing gait training devices.

Figure 7:
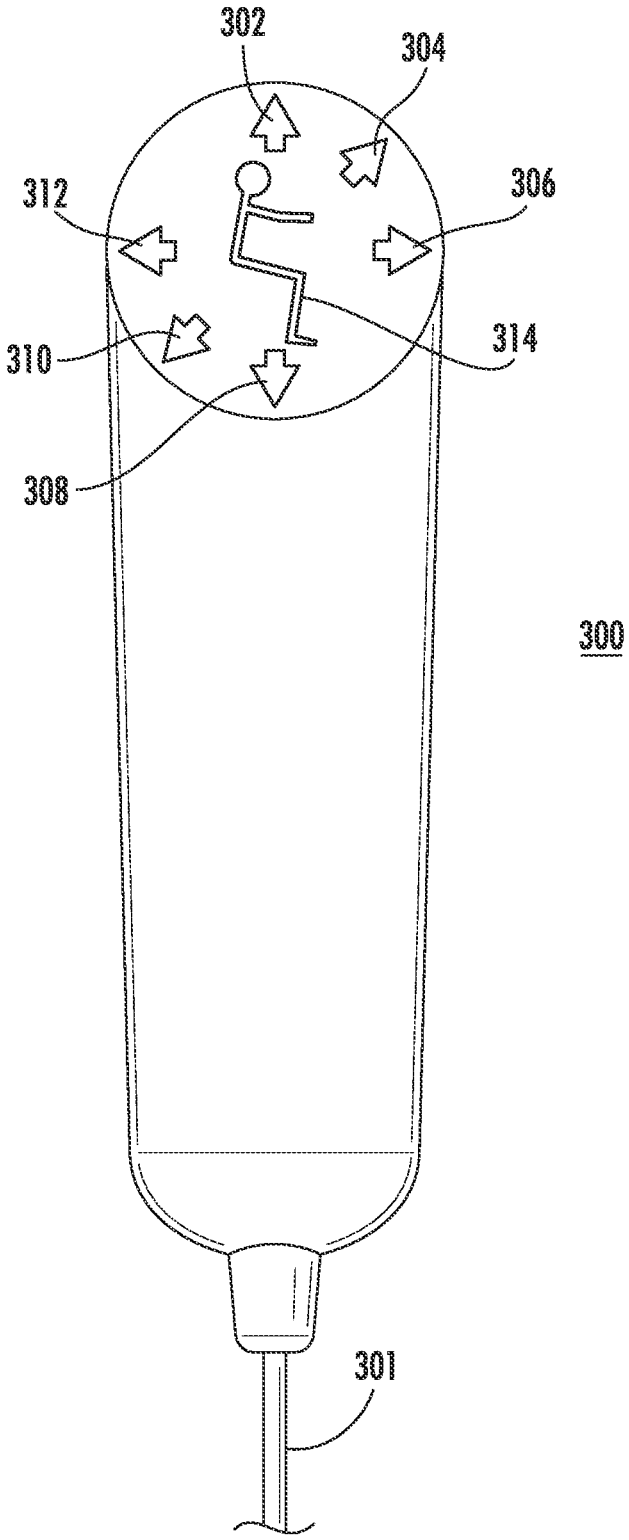
FIG. 7 is a front view of a hand control for controlling movement of elements of the device according to an embodiment of the invention.

FIG. 7 illustrates a manual control unit 300 of an embodiment of the invention by which a caregiver may command the movement assemblies 100, 150 to operate independently or in combination to effect movement of the body support assembly 30 along vertical, angled, or horizontal paths within the combined ranges of motion of the two movement assemblies. This unit 300 is connected through a cord 301 to a microprocessor-based system in the controller unit 212. However, in other embodiments, the unit 300 can have circuitry and a separate power supply which allows for a wireless connection to the controller unit 212.

The manual control unit 300 shown in FIG. 7 is a handheld pendant having six buttons 302, 304, 306, 308, 310, and 312 arrayed circularly around a depiction of a human FIG. 314. Each button corresponds to a command to move the body support assembly 30 in a desired direction relative to the base frame 12 of the device 10. More particularly: (1) button 302 commands upward vertical movement; (2) button 304 commands combined upward forward movement at approximately 45 degrees; (3) button 306 commands forward horizontal movement; (4) button 308 commands downward vertical movement; (5) button 310 commands downward rearward movement at approximately 45 degrees; and (6) button 312 commands rearward horizontal movement. However, this invention also envisions any indicia to communicate the functions of the different buttons. For example, instead of arraying the buttons around the figure of a person, each button could be labeled with text corresponding to its function. For example button 302 could be labeled with the word "up", button 304 with the words "forward/up" and so on, and need not be in a circular arrangement. Also, in one embodiment, the manual control unit 300 is directly mounted to the device 10 thereby removing the need for wire 301.

When one or more buttons 302, 304, 306, 308, 310, 312 are activated on the control unit 300, for example by depressing a spring-biased button contact switch in one embodiment, a signal is sent from the unit 300 to the controller unit 212. The controller unit 212 receives these signals and verifies that a disallowed combination of commands has not been selected, for example UP & DOWN, FORWARD & BACKWARD, DOWN & FORWARD. If an allowed combination is detected, for example UP & FORWARD, the controller unit 212 outputs command signals to one or both of the motors 106, 156 which cause the respective movement assembly 100, 150 to perform the command. If a disallowed combination is selected no signal is output from the controller unit 212 to either motor, and an audible beep is generated by a speaker (not shown) in the controller unit notifying the caregiver that an error has been made. Other embodiments of the invention envision the use of activators other than buttons, for example, icons on a touch-sensitive display.

In another embodiment of the invention, the manual control unit 300 could be fitted with a spring-return joystick switch (not shown), allowing caregivers to more easily and smoothly vary the angle of movement of the body support assembly 30. In still other embodiments, movement assemblies 100, 150 could allow variable speeds. Such variable speed movement assemblies used in combination with a joystick controller would also allow the caregiver to modulate the speed of movement of the body support assembly 30.

In an embodiment, the traveling ends 26, 32 of the respective movement assemblies 100, 150 have similar rates of travel. Accordingly, combined commands, for example, UP & FORWARD will move the body support assembly 30 at an approximately 45 degree angle with respect to the base frame 12. In a preferred embodiment, traveling ends 26, 32 have travel rates of approximately 38 to 50.8 millimeters per second (1.5 to 2 inches per second) yielding a comfortable and controlled rate of movement of the body support assembly 30. However, deviation above or below this rate by one or both of the traveling ends 26, 32 along with the resulting deviation in combined command travel angles of the body support are within the scope of this invention.

In one embodiment, depending on which activator 302, 304, 306, 308, 310, 312 is enabled by the caregiver on the manual control unit 300, the controller unit 212 switches on four of eight power MOSFETs (metal-on-silicon field-effect transistors). Each set of four MOSFETs are connected to an H-bridge (not shown) that supplies power to a respective linear actuator motor in a respective one of the linear actuators 104, 154. Based on the signals from the controller unit 212, each H-bridge can cause the motor: (1) to spin in a first direction; (2) to spin in a reverse direction; (3) to free-spin to a stop (disconnected), or (4) to dynamically brake (shorted).

For reasons of safety, the maximum amount of force that the movement assemblies 100, 150 can exert should be modulated depending on their position and direction of travel, individually, and also relative to the other movement assembly. In this way, the force exerted is never greater than that required by the particular action being performed by the device 10.

For example, when the body support assembly 30 is commanded to move forward and up through the pressing of a button 304, or buttons 302, 306 in combination, the motor of the horizontal actuator 154 must exert more force than when only horizontal movement is commanded. Such additional force may be needed because the horizontal movement assembly 150 may need to overcome the reactive force of the person's knees against the knee abutments 44 of the device 10.

As another example, the motor of the vertical actuator 104 should exert significantly less force when commanded to lower the body support assembly 30 as compared to raising the body support assembly, since the downward movement is aided by gravity.

Accordingly, the maximum amount of force may differ between various embodiments of the invention and also depends on the expected weight of the users and other factors such as, for example, the internal friction in the movement assemblies 100, 150. For example, in one embodiment, the maximum force for the horizontal movement assembly 150 was calculated to be approximately 300 Newtons for the sitting-to-standing procedure with a maximum weight user in the device 10. Although the maximum forces can be approximately calculated or measured in advance for each embodiment, in one embodiment, force gauges (not shown) are placed between the body support assembly 30 and the movement assemblies 100, 150 to provide a direct measure of the forces so that the controller unit 212 can limit the forces.

However, even without such gauges, in one embodiment, as long as an activator is causing command signals to be sent, the controller unit 212 measures the current supplied to both motors (not shown) every 100 milliseconds by measuring voltages across 0.05 ohm resistors between the H-bridge low side and the battery negative side. These current-sense inputs are smoothed with a 50 millisecond time constant RC (resistor-capacitor) circuit (not shown) to filter out brush motor noise, and are fed to 10-bit A/D (analog to digital) converters (not shown) in the controller unit 212. If either motor's current exceeds a pre-determined value, based on the direction of motion, both motors 106, 156 are turned off, that is all eight MOSFETs are de-energized and an audible beep is generated by the speaker in the controller unit 212 to signify an overload condition. This beep continues until the button is released, whereupon the controller unit 212 reverts to waiting for a new command signal from the manual control unit 300.

In one embodiment, the controller unit 212 may also turn off the motors 106, 156 when the controller detects the current being drawn by one or the other motor is rising at an abnormally fast rate, that is, the rate of rise exceeds a predetermined maximum rate of rise. Such an abnormal rate can occur, for example, if a caregiver inadvertently commands the horizontal movement assembly 150 to run too far forward with the person in the seated position. Unlike the current amount cutoff discussed above, the current rise rate cutoff detects and reacts to additional adverse conditions such as friction in the actuators 104, 154 being adversely changed by temperature, humidity, age, or wear.

Figure 8:
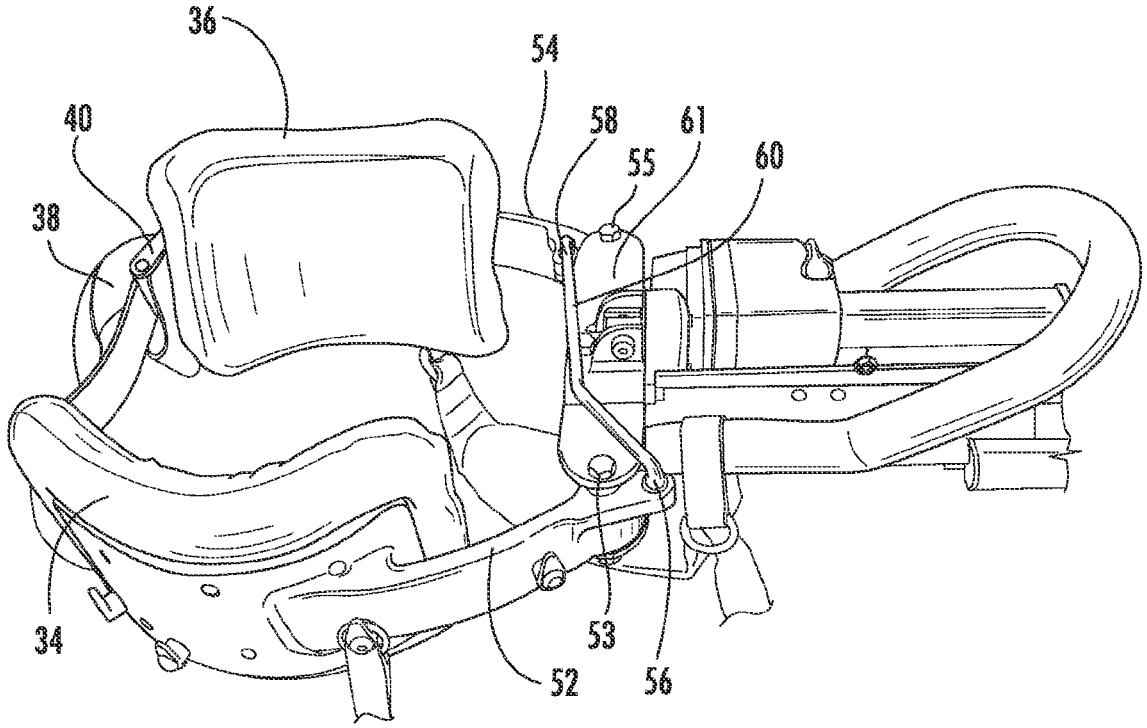
FIG. 8 is a perspective view of a body support assembly according to an embodiment of the invention
Figure 9:
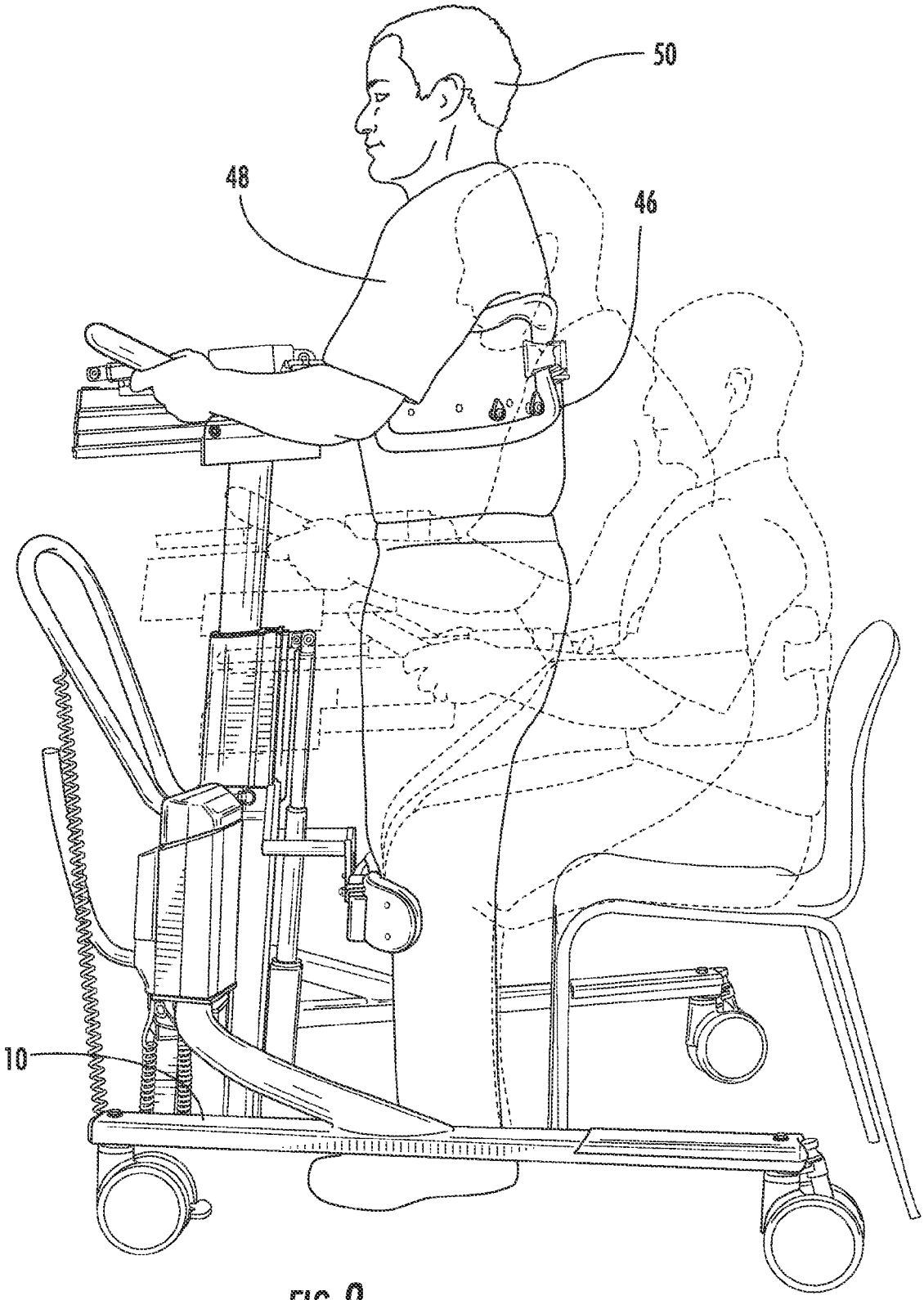
FIG. 9 is a side view of a device of an embodiment of the invention illustrating the use of the device as a sitting-to-standing aid.

As shown in FIGS. 8 and 9, in an embodiment of the invention, the pad assemblies 34, 36 of the body support assembly 30 have an approximate actuate shape to generally conform to the sides of the torso 46 beneath the arms 48 of the person 50 which provides a close fit so that the upper body of the person can be lifted stably. Because movement of the pad assemblies 34, 36 is required to accommodate people of different sizes, each pad assembly is attached to a respective pivot arm 52, 54 which pivots about a respective pivot joint 53, 55 located at the respective outer end of a rigid cross beam 61.

In addition, to help stably position the person along the centerline of the device, each pad assembly 34, 36 by the respective pivot arm 52, 54 also attaches to a respective end 56, 58 of a cross link 60 of the body support assembly 30. Accordingly, as shown in FIG. 8, as one pad assembly 34, 36 moves toward or away from the centerline of the device, the cross link 60 articulates the opposing pad assembly in the opposite direction which is also toward or away from the centerline. Because of this linkage, when the pad assemblies 34, 36 are in contact with the person's torso, and are secured into position, for example with straps 38 and buckles 40 which connect behind the person and prevent outward movement of the pad assemblies, the pad assemblies are effectively locked in position and hold the person 50 along the device's centerline.

As shown in FIGS. 1 and 12, straps or hooks 42 for raising the legs of the person by supporting the legs beneath the thigh are also attached to the body support assembly 30. Additionally, a padded abutment or pair of abutments 44 are attached to the vertical movement assembly 100 and are positioned to react against the knees or shins of the person when the device is used as a standing or a rising-sitting aid. Depending on which of the multiple functions of the device 10 are being used, the straps or hooks 42 and/or the abutments 44 should be removed, or as provided by articulation joints 45 moved out of the way.

In one embodiment, the pad assemblies 34, 36 are also rotationally connected to the pivot arms 52, 54 allowing the person's torso to rotate around the pad assemblies' lateral axis 62. This rotational connection permits the person to have some forward rotation as is natural during rising-sitting motions.

FIG. 9 illustrates the device 10 being used as a standing aid. When used as standing aid, the straps or hooks 42 are removed (as shown) or swung aside so as not to interfere with motion of the person's thighs as the person stands.

In the standing aid mode of operation, the caregiver uses the angled command buttons 304, 310 on the manual control unit 300 to command the vertical and horizontal movement assemblies 100, 150 to operate simultaneously which, as discussed above, causes the body support assembly 30 to move along an inclined path. This angled movement assists the person in rising to a standing position or in returning to a seated position. During this operation the caregiver may also use the horizontal and vertical command buttons 306, 312, 302, 308 to make any necessary corrections to the path taken by the body support assembly 30 during the rising or sitting motions. Thus, for example, if the person is of short stature and is being aided to rise from a relatively high object such as a bed, the caregiver may find it beneficial to use either the upward forward command button 304 or the upward vertical command button 302 to raise the person only a small amount to attain the standing height, and then to use the forward horizontal command button 306 to bring the person's torso forward to place him or her in the balanced standing position.

In one embodiment, a platform (not shown) is attached to and supported by the base frame 12 of the device 10. This platform is used to support the feet of the person so that the person can be transported in a standing or semi-standing position without the need to walk.

Figure 10:
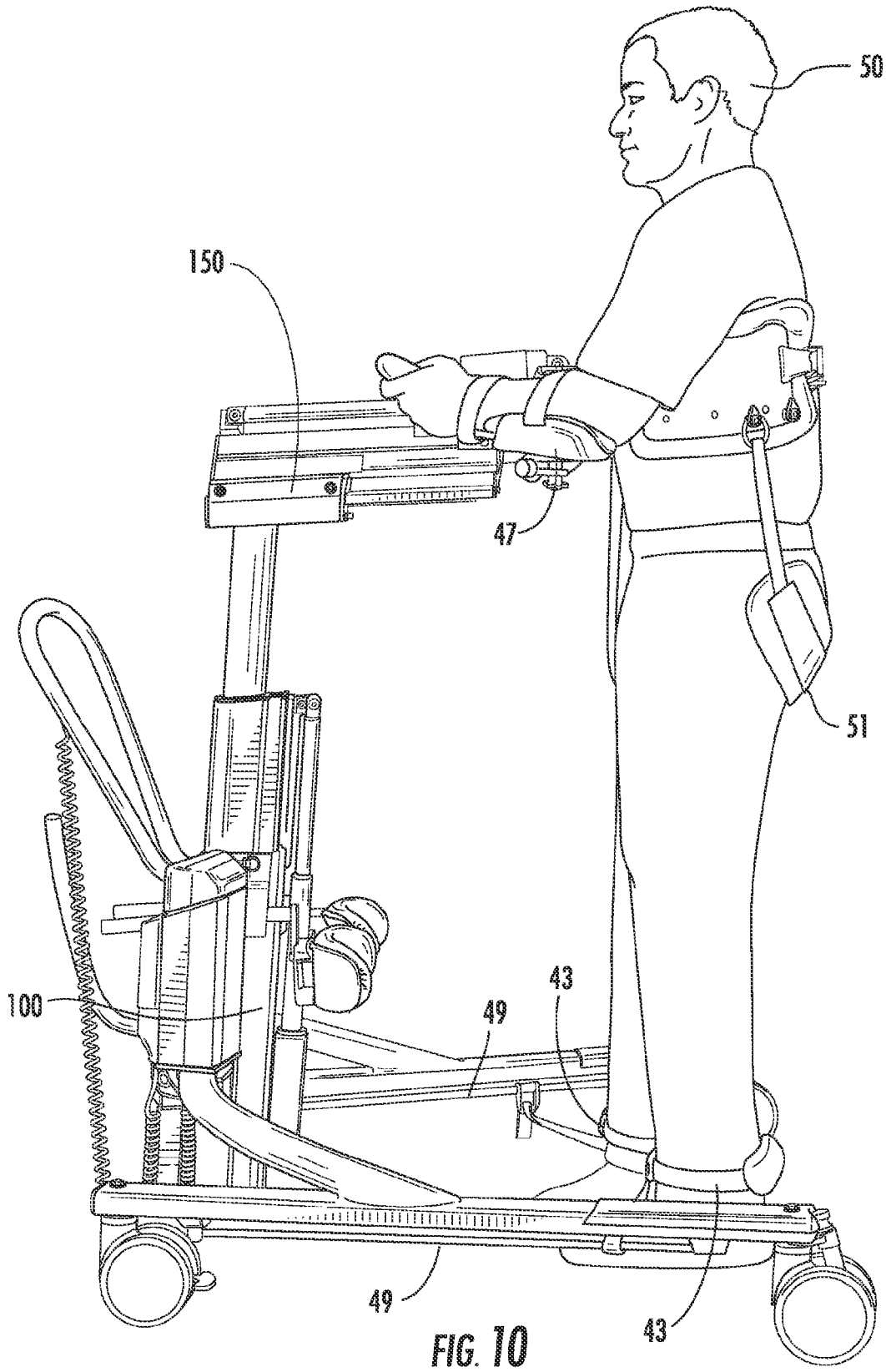
FIG. 10 is a side view of a device of an embodiment of the invention illustrating the use of the device as a walking aid.

FIG. 10 illustrates the device 10 being used as a gait training or walking aid. To aid walking, ankle straps 43 which slide forward and backward on rod assemblies 49 attached to the rails 20 can be used. In one embodiment, these assemblies 49 and the ankle straps 43 are removeable. Also, as when used as a standing aid, the leg straps or hooks 42 should be removed or articulated to a stowed position. In addition, the knee abutments 44 may, if necessary, be removed or articulated aside after the standing procedure is completed, so as not to interfere with the stride.

Once standing, the caregiver may use the horizontal command button 312 to position the person rearward with respect to the base frame 12 such that the person has adequate stability and stride clearance.

Figure 11:
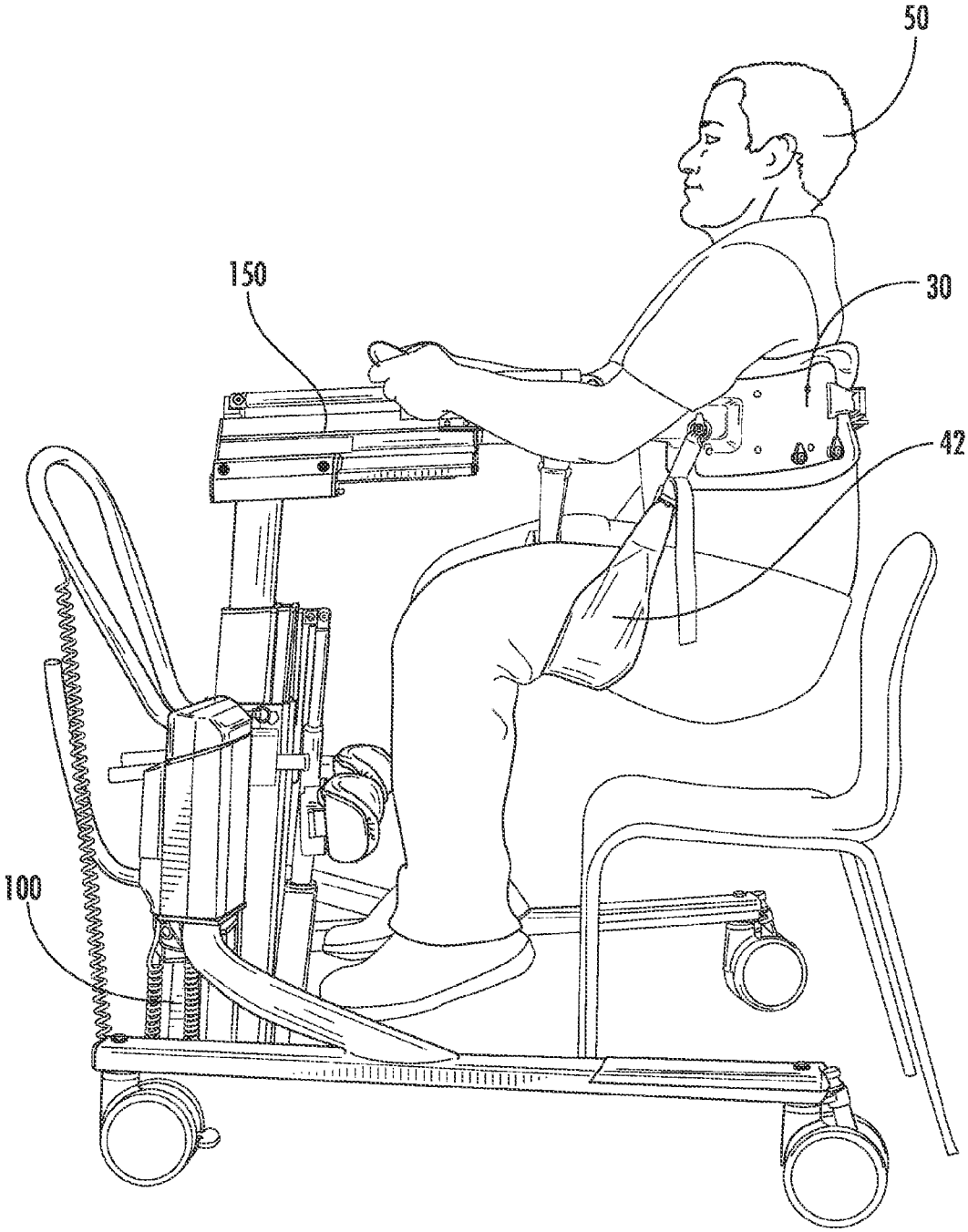
FIG. 11 is a side view of a device of an embodiment of the invention illustrating the use of the device as a lifting and transferring aid.

FIG. 11 illustrates the device being used for seated transfer. For this seated transfer function, the horizontal movement assembly 150 remains at full extension and both the straps or hooks 42 and the body support assembly 30 are employed to lift the person in a seated posture.

For seated transfer, the caregiver uses the vertical command buttons 302, 308 on the manual control unit 300 to command movement of the vertical movement assembly 100 to position the person to any height within the travel range of the assembly.

In one embodiment of the invention, an additional activator, such as a button or switch on the manual control unit 300, the device 10, or another control unit (not shown) allows the caregiver to completely disable movement of the horizontal movement assembly 150 which is particularly useful for seated transfer applications which do not necessarily require horizontal movement of the body support assembly 30.

For safety, appropriate labeling on the device and/or additional literature should be provided which sets forth the proper operation of the device with and/or without a person. For example, such labeling and literature should warn the user or caregiver to avoid excessive forward-only movement of the body support when the person is in the seated posture.

Throughout this application, the words describing the vertical and horizontal orientations of the movement assemblies 100, 150, should be interpreted only as describing the general orientation. Accordingly, and as particularly mentioned briefly above with respect to the vertical movement assembly 100, this invention's scope includes any angular orientation for one or both of the movement assemblies 100, 150 that vary from the vertical or horizontal plane by as much as 20 degrees. For example, angling the vertical movement assembly 100 toward the rear of the device 10 can enhance the device's stability and/or appearance without a significant negative effect.

Similarly, angling the horizontal movement assembly 150 so as to slope slightly downward toward the front of the device 10 may reduce the load on the assembly during the standing procedure which is when the load should be the greatest. This load reduction should occur because the person's weight should, by gravity, aid the forward movement of the traveling end 32. Such a reduction could permit the use of a less powerful horizontal movement assembly 150 which is likely more compact and less expensive. Indeed, in one embodiment, the horizontal movement assembly 150 angles down toward the front 24 of the device 10 at an approximately 3 degree angle with respect to the floor.

A plurality of accessories known in the gait training field as "prompts" are provided to be optionally attached to the device 10, to give the caregiver a means to guide and support the person's limbs during gait training. These accessories include the ankle guides 43, 49 and the hand and forearm supports 47 shown in FIG. 10, but may also include thigh guides, head and neck supports, and hip and pelvic supports.

One particularly beneficial accessory is a sling style pelvic support 51 which can be placed between the person's thighs and under the buttocks when the person is in a standing position. This support provides added lift, comfort and security during subsequent walking activities, especially for a person with low upper body strength. The aforementioned gait training accessories are available from Rifton Equipment of New York.

The aforementioned embodiments are given by way of example only, and various modifications will be apparent, to persons skilled in the art, which do not depart from the scope of this invention. For example, persons skilled in the art may find or employ other mechanisms that provide substantially linear movement over an adequate distance thereby yielding a functional device within the scope of this invention.

We claim:

1. A person handling device comprising:

a base having a front end and rear end;

a first linear movement assembly having an adjustable length extending upwardly from a first end, which is connected to the front end of the base, to a second end;

a second linear movement assembly having an adjustable length extending along a longitudinal axis thereof and extendable away from a first end, which is connected proximate to the second end of the first linear movement assembly, to a second end;

a body support attached to the second end of the second linear movement assembly along the longitudinal axis of the second linear movement assembly, such that each of the first linear movement assembly and the second linear movement assembly have at least one respective activator that permits each movement assembly to adjust the respective length independently of the other movement assembly, and a control unit having:

an upward vertical activator for extending the first linear movement assembly, a downward vertical activator for retracting the first linear movement assembly, a forward horizontal activator for retracting the second linear movement assembly, and a rearward horizontal activator for extending the second linear movement assembly.

2. The device of claim 1, wherein the control unit further comprises:

an upward vertical and forward horizontal activator for extending the first linear movement assembly and retracting the second linear movement assembly; and a downward vertical and rearward horizontal activator for retracting the first linear movement assembly and extending the second linear movement assembly.

3. The device of claim 1, wherein the body support further comprises:

a first pad assembly;

a second pad assembly; and a centering mechanism connecting the first pad assembly to the second pad assembly, such that the movement of one pad assembly moves the other pad assembly to maintain the body support along the center line of the device.

4. The device of claim 1, further comprising an excessive force detection circuit having:

a current monitoring circuit which detects at least one of current above a predetermined threshold or current rate of rise above a predetermined maximum rate of rise driving at least one of the movement assemblies; and a shut-off circuit which stops movement of the movement assemblies when the detected current exceeds the predetermined threshold or the current rate of rise exceeds the predetermined maximum rate of rise.

5. The device of claim 4, wherein at least part of the current monitoring circuit and at least part of the shut-off circuit are provided by program instructions in a controller attached to the device.

6. The device of claim 1, further comprising:

at least one abutment attached to the base for contacting a person's shin or knee, the abutment having an articulation joint allowing the abutment to be moved relative to the base.

7. The device of claim 1, further comprising at least one abutment removeably attached to the base for contacting a person's shin or knee.

8. A body support for supporting a person on a person handling device comprising:

a first pad assembly;

a second pad assembly; and a centering mechanism connecting the first pad assembly to the second pad assembly, such that the movement of one pad assembly in a direction toward a center line of the device moves the other pad assembly in a direction toward the center line of the device to support the person in the body support along the center line of the device.

9. The body support of claim 8, wherein the centering mechanism is a cross link.

10. The body support of claim 8, further comprising a locking device to prevent outward movement of the first pad assembly and the second pad assembly.

11. The body support of claim 10, wherein the locking device includes at least a strap and a buckle.

12. A person handling device comprising:

a movable base having a front end and rear end;

a first linear movement assembly having first end, a second end, and an adjustable length between the first end and the second end, wherein the first end of the first linear movement assembly is connected to the front end of the moveable base and wherein the first linear movement assembly has at least one activator that permits the first linear movement assembly to adjust the length independently of the moveable base;

a second assembly having a length and extending along a longitudinal axis, wherein a proximal end of the second assembly is attached to the second end of the first linear movement assembly; and a body support attached to a distal end of the second assembly along the longitudinal axis of the second assembly, wherein the body support comprises:

a first pad assembly, a second pad assembly, and a centering mechanism connecting the first pad assembly to the second pad assembly, such that the movement of one pad assembly moves the other pad assembly to maintain the body support along the center line of the device.

13. The device of claim 12, further comprising an excessive force detection circuit having:

a current monitoring circuit which detects at least one of current above a predetermined threshold or current rate of rise above a predetermined maximum rate of rise driving the first linear movement assembly; and a shut-off circuit which stops movement of the first linear movement assembly when the detected current exceeds the predetermined threshold or the current rate of rise exceeds the predetermined maximum rate of rise.

14. The device of claim 13, wherein at least part of the current monitoring circuit and at least part of the shut-off circuit are provided by program instructions in a controller attached to the device.

15. The device of claim 12, wherein the centering mechanism is a cross link.

16. The device of claim 12, further comprising:

at least one thigh support attached to the body support, the thigh support having an articulation joint allowing the thigh support to be moved relative to the body support.

17. The device of claim 12, further comprising at least one thigh support removeably attached to the body support.

18. The device of claim 12, wherein the base further comprises:

two side rails; and a cross beam, the cross beam having a first portion and a second portion, each portion connected at one end to a respective side rail and connected at the other end to a respective articulation joint, the articulation joints being connected to the first linear movement assembly.

19. The body support of claim 12, further comprising a locking device to prevent outward movement of the first pad assembly and the second pad assembly.

20. The body support of claim 19, wherein the locking device includes at least a strap and a buckle.

* * * * *